US007515048B1

(12) United States Patent
Bhattiprolu et al.

(10) Patent No.: US 7,515,048 B1
(45) Date of Patent: Apr. 7, 2009

(54) METHOD AND SYSTEM FOR USING RFID TO AUTOMATICALLY LOCK AND UNLOCK A MOBILE COMPUTING DEVICE

(75) Inventors: Sukadev Bhattiprolu, Beaverton, OR (US); Haren Myneni, Tigard, OR (US); Malahal R. Naineni, Tigard, OR (US); Chandra Seetharaman, Portland, OR (US); Narasimha N. Sharoff, Beaverton, OR (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/124,012

(22) Filed: May 20, 2008

(51) Int. Cl.
*G08B 13/14* (2006.01)

(52) U.S. Cl. ..... 340/572.4; 340/572.1; 340/572.7; 340/825.49; 340/5.64; 340/5.7; 340/569

(58) Field of Classification Search ..... 340/572.4, 340/572.1, 572.7, 825.49, 5.64, 5.7, 569
See application file for complete search history.

(56) References Cited

U.S. PATENT DOCUMENTS 6,924,735 B2 * 8/2005 Ueda et al. ..... 340/426.28
7,034,657 B2 * 4/2006 Ueda et al. ..... 340/5.62
2007/0164847 A1 7/2007 Crawford et al.
2007/0257772 A1 11/2007 Marcelle et al.
2007/0296545 A1 12/2007 Clare

FOREIGN PATENT DOCUMENTS

GB 2437108 10/2007

* cited by examiner

*Primary Examiner*—Tai T Nguyen
(74) *Attorney, Agent, or Firm*—King & Spalding LLP

(57) ABSTRACT

Methods and systems for using radio frequency identification ("RFID") to automatically lock and unlock a mobile computing device. An RFID transceiver is installed in connection with a locking device. The locking device can secure the mobile computing device to a cable, which is securable to a physical structure. An RFID transmitter is configured to detect a signal from the RFID transceiver within a predetermined distance range and send a response signal to the RFID transceiver. If the RFID transmitter is within the range, the RFID transceiver detects the response signal from the RFID transmitter and issues an unlocking signal to change the position of the locking device to an unlocked position. If the RFID transmitter is outside of the range, the RFID transceiver does not detect a response signal from the RFID transmitter, and issues a locking signal to change the locking device position to a locked position.

1 Claim, 2 Drawing Sheets

METHOD AND SYSTEM FOR USING RFID TO AUTOMATICALLY LOCK AND UNLOCK A MOBILE COMPUTING DEVICE

FIELD OF THE INVENTION

This invention relates to a method and system for using radio frequency identification ("RFID") to automatically lock and unlock a mobile computing device. More particularly, the invention enables a mobile computing device to be automatically locked when an RFID configured locking device is outside of a predetermined distance range of the mobile computing device.

BACKGROUND OF THE INVENTION

Conventional methods for locking mobile computing devices involve securing the mobile computing device to a physical structure using a cable with a lock and key. The lock is inserted into a side of the mobile computing device, and the key is turned in the lock to lock it. The user of the mobile computing device typically carries the key with them, and must lock and unlock the mobile computing device frequently.

Locking of the mobile computing device when the user is not in the vicinity of the mobile computing device is required for security reasons, to prevent theft or other damage to the mobile computing device. Certain companies maintain security policies that require employees to lock the mobile computing device when the user is not nearby. Failure to do so could result in a security violation, and/or theft of the mobile computing device.

However, conventional methods for locking and unlocking mobile computing devices involve manual labor, frequent locking and unlocking, and the propensity for the mobile computing device to inadvertently be left unlocked. The user must remember to lock the mobile computing device each time he or she leaves the workstation area and must carry a key. Locking of the mobile computing device can also be cumbersome, as the lock may be hard to reach, difficult to turn, and otherwise unwieldy.

Thus, a need exists in the art for a more efficient and effective way to lock and unlock a mobile computing device to overcome one or more of the limitations described above.

SUMMARY OF THE INVENTION

The invention uses radio frequency identification ("RFID") to automatically lock and unlock a mobile computing device. A locking device is connected to a cable which is used to secure the mobile computing device. A change in position of the locking device occurs based on the location of an RFID transmitter, which is typically maintained under the control of the user and/or owner of the mobile computing device, relative to an RFID transceiver, which is connected to the locking device. When the RFID transmitter is positioned within a predetermined range of the RFID transceiver, the locking device remains in an unlocked position. When the RFID transmitter is moved to a position outside of the predetermined range of the RFID transceiver, the locking device changes to a locked position.

An RFID transceiver is installed in connection with the locking device and emits a signal. The RFID transmitter can detect the signal from the RFID transceiver within the predetermined distance range from the RFID transceiver. The RFID transmitter sends a response signal to the RFID transceiver in response to detecting the signal from the RFID transceiver.

If the RFID transceiver detects the response signal from the RFID transmitter, the position of the locking device is changed to an unlocked position. The unlocked position disables a secure connection between the mobile computing device and the cable. If, on the other hand, the RFID transceiver fails to detect the response signal from the RFID transmitter, the position of the locking device is changed to a locked position. The locked position enables a secure connection between the mobile computing device and the cable.

Accordingly, the invention allows for automatic locking and unlocking of a mobile computing device, based on the location of an RFID transmitter in relation to an RFID transceiver associated with a locking device, where the RFID transmitter can be carried in the possession of the user and/or owner of the mobile computing device.

DETAILED DESCRIPTION OF THE EXEMPLARY EMBODIMENTS

Exemplary embodiments use RFID technology to automatically lock and unlock a mobile computing device. An RFID transceiver is installed in connection with a locking device. The locking device can secure the mobile computing device to a cable, and the cable is securable to a physical structure. An RFID transmitter is configured to detect a signal from the RFID transceiver within a predetermined distance range and, in response, to send a response signal to the RFID transceiver. If the RFID transmitter is within the predetermined distance range, the RFID transceiver detects the response signal from the RFID transmitter and the position of the locking device is changed to an unlocked position. If the RFID transmitter is outside of the predetermined distance range, the RFID transceiver does not detect a response signal from the RFID transmitter and the position of the locking device is changed to a locked position.

A method and system for using RFID to automatically lock and unlock a mobile computing device will now be described with reference to FIGS. 1-2, which depict representative or illustrative embodiments of the invention.

Figure 1:
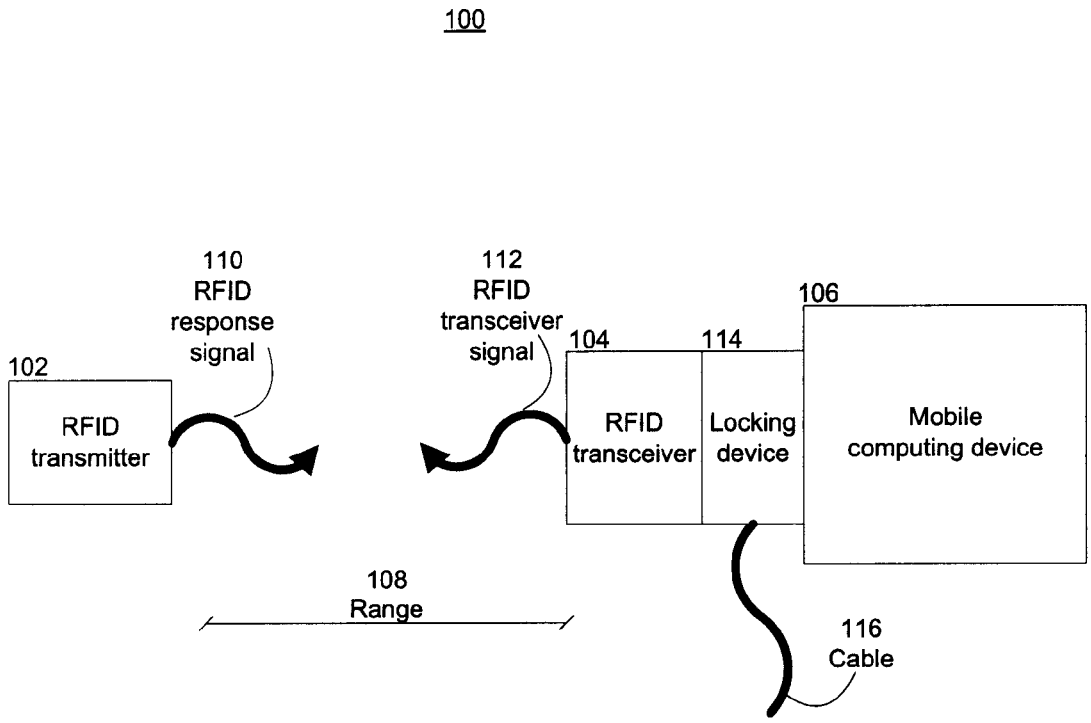
FIG. 1 is a block diagram depicting a system architecture for using RFID to automatically lock and unlock a mobile computing device, in accordance with an exemplary embodiment of the present invention.

FIG. 1 is a block diagram depicting a system architecture 100 for using RFID technology to automatically lock and unlock a mobile computing device, in accordance with an exemplary embodiment of the present invention. As shown in FIG. 1, a cable 116 can be secured to the mobile computing device 106 by a locking device 114. For example, an end of the cable 116 can be inserted into the locking device 114. In an exemplary embodiment, the locking device 114 is a mechanism for securing the cable 116 to the mobile computing device 106, and can be placed in either a "locked" or "unlocked" position. When the locking device 114 enables a secure connection between the cable 116 and the mobile computing device 106, the locking device 114 is in a "locked" position. When the locking device 114 disables a secure connection between the cable 116 and the mobile computing device 106, the locking device 114 is in an "unlocked" position.

The locking device 114 can be coupled to the mobile computing device 106, typically via the cable 116. The locking device 114 can include an independent power supply, to be accessed in order to facilitate the change in positions from locked to unlocked, and responsive to a control signal output by an associated RFID device. The mobile computing device 106 can be, for example, a laptop computer, a personal data assistant, and/or another type of computing device.

The cable 116 can be a wire, cable, or chain that is flexible and yet resistant to breaches in its integrity. The cable 116 can be secured to a physical structure, for example, a piece of furniture and/or a post.

An RFID transceiver 104 is installed in connection with the locking device 114, and is configured to communicate with the locking device 114. The RFID transceiver 104 emits an RFID transceiver signal 112, typically on a continuous or regular basis. The RFID transceiver 104 is also configured to receive an RFID response signal 110.

In an exemplary embodiment, the RFID transceiver 104 and locking device 114 can be installed in various configurations. For example, the RFID transceiver 104 and locking device 114 can be installed inside and/or adjoining the mobile computing device 106. In this example, an end of the cable 116 can be inserted into the locking device 114 that is inside and/or adjoining the mobile computing device 106. Thus, in this example, the mobile computing device 106 is continuously connected to the RFID transceiver 104 and the locking device 114.

In yet another example, the RFID transceiver 104 and locking device 114 can be coupled to the cable 116. In this example, the RFID transceiver 104 and locking device 114 can be couple to one end of the cable 114, which can be inserted into the mobile computing device 106, or otherwise secured to the mobile computing device 106, for locking. In this embodiment, the RFID transceiver 104, locking device 114, and cable 116 are continuously connected.

In yet another example, the RFID transceiver 104 and locking device 114 can be independent of each other, and connectable by a user to the cable 116 and/or the mobile computing device 106 for locking purposes.

An RFID transmitter 102 is a passive RFID tag that does not have an internal power supply. The RFID transmitter 102 is configured to respond to a radio frequency signal output by the RFID transceiver 104. In an exemplary embodiment, the RFID transmitter 102 is small and can take on various shapes and configurations. For example, it can be attached to a keychain, carried in a wallet, embedded in a sticker, and/or carried in another location. The RFID transmitter 102 is typically held under the control of the mobile computing device user.

The RFID transmitter 102 emits an RFID response signal 110 when it detects the RFID transceiver signal 112. Because the RFID transmitter 102 does not have an internal power supply, it uses the power received from the RFID transceiver signal 112 to send the RFID response signal 110. In other words, it redirects the energy it receives in the form of the RFID response signal 110.

The RFID transceiver 104 typically can detect the RFID response signal 110 within a distance range 108 from the RFID transmitter 102. In the presence of the RFID response signal 110, the RFID transceiver 104 issues a control signal that places the locking device 114 in an unlocked position. In the absence of the RFID response signal 110 (for a predetermined time period), however, the RFID transceiver 104 issues a control signal that places the locking device 114 in a locked position.

The range 108 is the distance between the RFID transceiver 104 and the RFID transmitter 102, within which the RFID transceiver 104 can detect the RFID response signal 110. In other words, the range 108 is the operational range of the RFID transmitter 102. In an exemplary embodiment, the range can be between several inches and up to a few meters. The range 108 can also be configured based on the user workspace and preference. For example, if the workspace is small, the range 108 can be short, so as to lock the mobile computing device when the user is outside of the workspace. In addition, certain factors can affect the range 108, for example, physical and/or radio frequency interference between the RFID transmitter 102 and the RFID transceiver 104 can reduce the range 108. Outside of the range 108, the RFID transceiver 104 cannot detect the RFID response signal 110.

Figure 2:
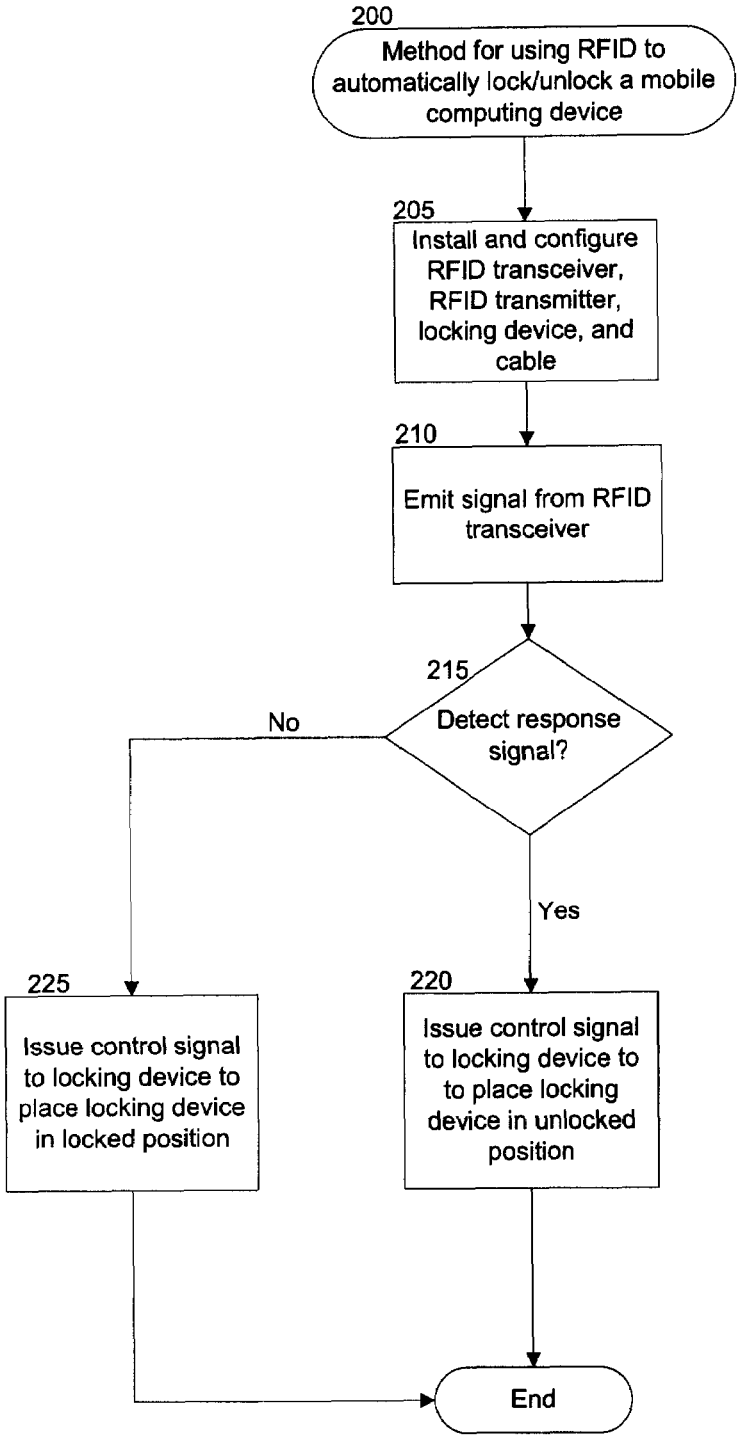
FIG. 2 is a flow chart depicting a method for using RFID to automatically lock and unlock a mobile computing device, in accordance with an exemplary embodiment of the present invention.

FIG. 2 is a flow chart depicting a method 200 for using RFID to automatically lock and unlock a mobile computing device, in accordance with an exemplary embodiment of the present invention. The exemplary method 200 is illustrative and, in alternative embodiments of the invention, certain steps can be performed in a different order, in parallel with one another, or omitted entirely, and/or certain additional steps can be performed without departing from the scope and spirit of the invention. The method 200 is described hereinafter with reference to FIGS. 1-2.

In step 205, an administrator installs the RFID transceiver 104, the RFID transmitter 102, the locking device 114, and the cable 116. These components can be installed in various configurations, as described herein with reference to FIG. 1. In addition, the administrator can also configure the RFID transmitter 102 such that it responds only to the RFID transceiver signal 112, and not to other radio frequency signals emitted by other RFID devices. In step 205, the administrator can also configure the RFID transceiver 104 to communicate with the locking device 114 in response to receiving, or failing to receive, the RFID response signal 110 from the RFID transmitter 102.

In step 210, the RFID transceiver 104 emits the RFID transceiver signal 112. The RFID transceiver signal 112 was described previously herein with reference to FIG. 1.

In step 215, the RFID transceiver 104 determines whether it has detected the RFID response signal 110. If the RFID transmitter 102 is within the range 108, the RFID transmitter 102 detects the RFID transceiver signal 112, and sends a response signal 110 which can be detected by the RFID transceiver 104. If the RFID transmitter 102 is outside of the range 108, the RFID transmitter 102 fails to detect the RFID transceiver signal 112, and, accordingly, cannot send an RFID response signal 110 that can be detected by the RFID transceiver 104.

If, in step 215, a determination is made that the RFID transceiver 104 detects the RFID response signal 110, the method proceeds to step 220.

In step 220, the RFID transceiver 104 issues a control signal that places the locking device 114 in an unlocked position. If the locking device 114 is already in an unlocked position, the locking device 114 remains in the unlocked position in step 220. The unlocked position disables a secure connection between the cable 116 and the mobile computing device 106. Accordingly, when the user is working on the mobile computing device 106 within the predetermined range 108, the locking device 114 will be in an unlocked position.

Referring back to step 215, if a determination is made that the RFID transceiver 104 does not detect the RFID response signal 110, the method proceeds to step 225.

In step 225, the RFID transceiver 104 issues a control signal that places the locking device 114 in a locked position. If the locking device 114 is already in a locked position, the locking device 114 remains in the locked position in step 225. The locked position enables a secure connection between the cable 116 and the mobile computing device 106. Accordingly, the mobile computing device 106 is locked at times when the user, carrying the RFID transmitter 102, is outside of the predetermined range 108. The method then ends.

One of ordinary skill in the art would appreciate that the present invention supports systems and methods for using RFID to automatically lock and unlock a mobile computing device. Although specific embodiments of the present invention have been described above in detail, the description is merely for purposes of illustration. Modifications of, and equivalent steps corresponding to, the disclosed aspects of the exemplary embodiments, in addition to those described above, can be made by those skilled in the art without departing from the spirit and scope of the present invention defined in the following claims, the scope of which is to be accorded the broadest interpretation so as to encompass such modifications and equivalent structures.

What is claimed:

1. A method for automatically locking and unlocking a mobile computing device, comprising the steps of:

installing a radio frequency identification ("RFID") transceiver in connection with a locking device, wherein the locking device secures the mobile computing device to a cable, the cable securable to a physical structure;

emitting a signal from the RFID transceiver;

sending a response signal from an RFID transmitter to the RFID transceiver in response to detecting the signal from the RFID transceiver, the RFID transmitter operative to detect the signal from the RFID transceiver within a predetermined distance range from the RFID transceiver;

in response to detecting the response signal from the RFID transmitter by the RFID transceiver, changing a position of the locking device to an unlocked position that disables a secure connection between the mobile computing device and the cable; and in response to failing to detect a response signal from the RFID transmitter by the RFID transceiver within a predetermined time period, changing the position of the locking device to a locked position that enables the secure connection between the mobile computing device and the cable.

* * * * *